United States Patent [19]

Hill et al.

[11] Patent Number: 4,607,568

[45] Date of Patent: Aug. 26, 1986

[54] EXTENSIBLE LINE BRATTICE

[75] Inventors: George R. Hill, Pleasant Grove; Larry C. Jordan, Vance, both of Ala.

[73] Assignee: Jim Walter Resources, Inc., Birmingham, Ala.

[21] Appl. No.: 763,115

[22] Filed: Aug. 7, 1985

[51] Int. Cl.[4] ..... E21F 1/00

[52] U.S. Cl. ..... 98/50; 160/201; 299/12

[58] Field of Search ..... 98/50; 160/371, 379, 160/369, 201; 299/12

[56] References Cited

U.S. PATENT DOCUMENTS

| | | | |
|---|---|---|---|
| 2,729,065 | 1/1956 | Craggs et al. | 98/50 |
| 3,095,034 | 6/1963 | Francis | 160/369 |
| 3,389,514 | 6/1968 | Horvath | 160/201 |
| 3,715,969 | 2/1973 | Burgess, Jr. | 98/50 |
| 4,180,352 | 12/1979 | Divers et al. | 98/50 |
| 4,282,802 | 8/1981 | Divers et al. | 98/50 |
| 4,494,894 | 1/1985 | Divers et al. | 98/50 |
| 4,542,681 | 9/1985 | Milam | 98/50 |

OTHER PUBLICATIONS

"The Use of Brattice Cloth in Coal Mines", Reports of Investigations, Department of Commerce-Bureau of Mines, Serial No. 2873, May, 1928.

"Flame Spread Evaluation of Ventilation Cloth", Bureau of Mines Report of Investigations/1972-RI 7625.

"Bureau of Mines Damage-Resistant Brattice" Bureau of Mines Report of Investigations/1978, RI 8270.

"Problem-Solving Uses of Equipment-a Key to Evolving Technology", USBM Develops Damage-Resistant Brattice, Engineering and Mining Journal-Sep., 1978.

"Mobile Curtain", Mining Journal—Dec. 29, 1978, p. 506.

*Primary Examiner*—Ronald C. Capossela

*Attorney, Agent, or Firm*—James W. Grace; Charles W. Vanecek

[57] ABSTRACT

This invention pertains to an extensible line brattice which comprises a track system and an extensible brattice frame with an attached brattice cloth cover mounted on said track system for extension into an unprotected portion of a mine passageway.

5 Claims, 5 Drawing Figures

EXTENSIBLE LINE BRATTICE

BACKGROUND OF THE INVENTION

Field of the Invention

This invention relates to line brattices in mines and more particularly to an extensible line brattice.

In underground mining operations, and in particular in the mining of coal in deep mines, control of ventilation is of critical importance. It is known that proper ventillation is necessary especially in those mines which are subject to gaseous conditions. Proper ventilation consists of moving large quantities of fresh air in the proper direction through the mine passageways.

In many instances the direction of the flow of fresh air is controlled by fixed walls called "mine stoppings." These permanent installations direct the air within the mine passageways throughout most of the mine.

At times temporary installations called "line brattices" are used prior to or in place of the installation of the permanent mine stoppings to control the flow of fresh air in areas where active mining is still going on. Such "line brattices" are conventional and usually comprise a frame made of mine timbers erected at spaced distances and a brattice cloth attached to the mine timbers to form a curtain which directs the flow of air in the mine. The brattice cloth may be jute, canvas or scrim-reinforced plastic material. "Line brattices" normally extend from a fixed end connected to a wall in the mine to a free end around which air can flow.

For safety reasons the roof areas of mines are supported by roof bolts. Roof bolts are long metal rods secured in the roof of the mine and support plates having substantial surface areas to keep the roof of the mine from collapsing.

At times the mine workers may be required to install line brattices in areas that have not yet been supported by the roof bolt and plate installations. At other times, mine workers may have to cross areas where roof bolts and plates have not been installed.

To provide for the safety of mine workers, it has been found advantageous to provide an extensible line brattice so that the flow of fresh air can be controlled in areas unprotected by roof bolts and plates. An extensible line brattice is connected to the free end of the line brattice.

It is important that there be proper ventilation at the working face of the mine and this can be accomplished by moving an extensible line brattice into place as the mining operation continues.

Various types of extensible line brattices have been suggested but have been rejected because they were impractical. Extensible line brattices which have not been practical have included those with tracks placed in or on the ground level of the mine passageway. Because of dirt and lumps of mined material, these tracks become clogged and useless.

SUMMARY OF THE INVENTION

The invention relates to an extensible line brattice which can be extended by pushing a moveable brattice section from a protected area to an unprotected area in a mine passageway.

It is, therefore, an object of this invention to provide a novel extensible line brattice structure which can be extended into unprotected areas of mines.

It is another object of the present invention to provide a novel extensible line brattice structure which can be economically made and is simple to use.

It is yet another object of the present invention to provide a novel extensible line brattice structure which can be used to quickly extend a pre-existing line brattice into an operating area until mine conditions are proper for the safe installation of a more permanent line brattice.

DESCRIPTION OF THE PREFERRED EMBODIMENT

These and other objects and advantages of the present invention will become apparent to those skilled in the art from a consideration of the description of the invention taken in conjunction with the drawing in which like numbers indicate like elements and in which.

Figure 1:
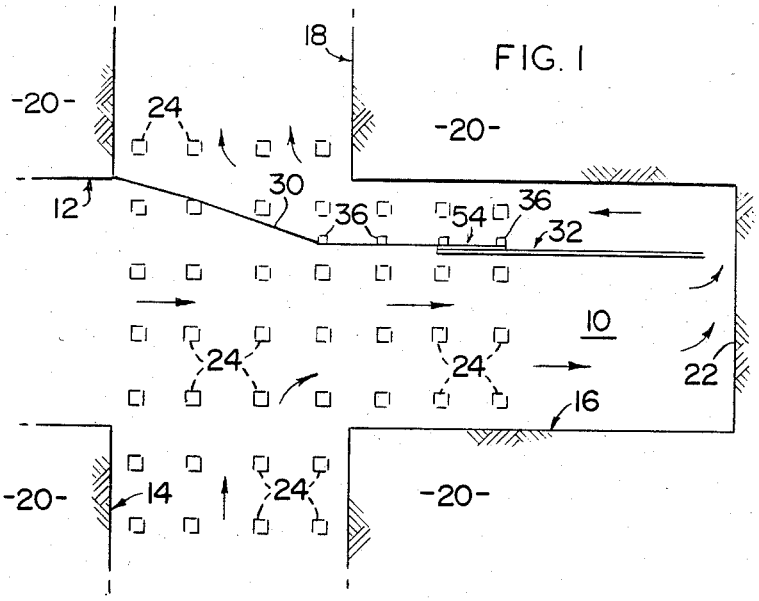
FIG. 1 is a plan view of a mine illustrating the invention.

Referring now to the drawing and particularly to FIG. 1 thereof, there is shown a mine 10 comprising passageways 12, 14, 16 and 18. The passageways 12, 14, 16 and 18 are cut into the ground 20 in horizontal directions deep below the surface of the earth. The height of passageways 12, 14, 16 and 18 is sufficient to permit movement of equipment and miners throughout these passageways. In FIG. 1, there is shown a series of passageways in the form of a cross with passages 12, 14, 16 and 18 forming the arms and main frame of the cross. For purposes of explaining the invention, it will be assumed that active mining of minerals, such as coal, is being carried out in passageway 16 and that access to passageway 16 can be achieved through passageways 12, 14 and 18.

The mining operation per se forms no part of the invention but may be summarized by assuming that a mine coal cutter (not shown) is operating against face 22 of passageway 16. The mined coal may be removed from passageway 16 by conveyor belts (not shown). The coal has been previously removed from passageways 12, 14 and 18 and from passageway 16 up to face 22.

To prevent collapse of the roof of passageways 12–18, roof plates and roof bolts 24, represented herein as small squares 24 are secured to the roof of the passageways. As active mining continues in passageway 16, there will be an area which has no roof plates and roof bolts (shown in the right hand area of passageway 16 and designated by the absence of small squares). Roof plates and roof bolts 24 may be those shown and claimed in U.S. Pat. Nos. 4,347,020 entitled "Mine Roof Bolt Assembly" and 4,483,645 entitled "Combination Expansion Shell and Resin Secured Mine Roof Anchor Assembly."

In FIG. 1, there is shown a line brattice 30 with an extensible line brattice 32. Line brattice 30 may be a conventional line brattice comprising vertical supports which may be mine timbers 36 which extend from the floor to the ceiling of the mine between upper and lower plates 40 and 42. Brattice cloth 44 is attached to this framework to form a line curtain to control the flow of ventilating air. The extensible line brattice 32 of the invention is shown as being connected to the free end of line brattice 30. The direction of the flow of air for ventilation is shown in FIG. 1 by the arrows therein. It can be seen that the air flow originates in passages 12 and 14 and moves across the working face 22 of passageway 16 and exits through passageway 18.

Figure 2:
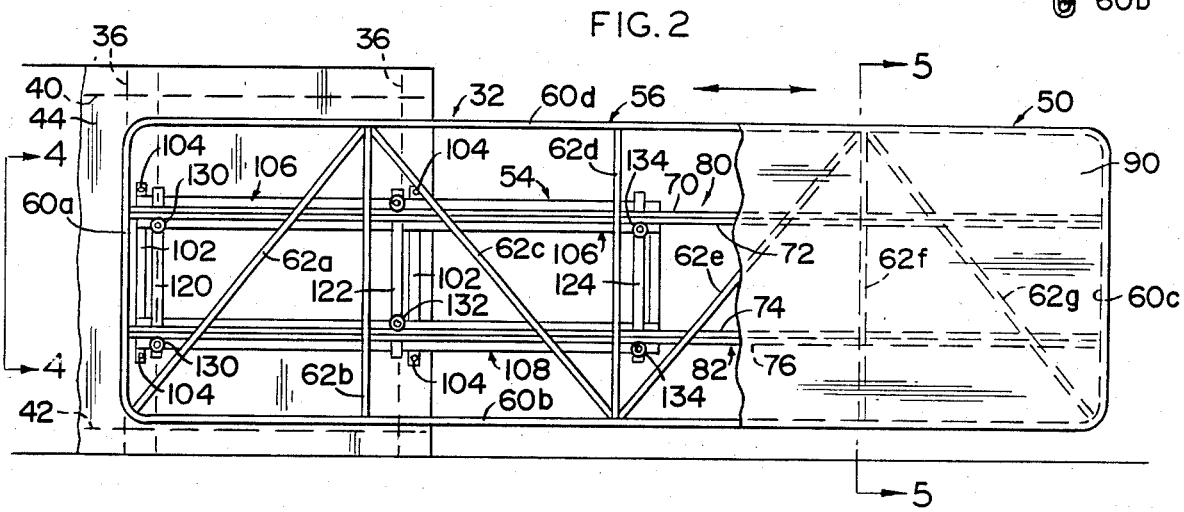
FIG. 2 is a side elevational view of the novel extensible line brattice of the invention.

As may be seen best in FIG. 2, extensible line brattice 32 generally comprises a moveable frame 50 and a fixed frame guide or track system 54.

Moveable frame 50 comprises a rectangular frame 56 which may be made of hollow metal or plastic tubes 60*a*, 60*b*, 60*c* and 60*d* joined at their ends to form a rectangular frame. Reinforcing tubes 62*a*, 62*b*, 62*c*, 62*d*, 62*e* and 62*f* are connected to tubes 60*a*–60*d* to give rigidity to rectangular frame 56. Extending rearwardly at right angles to tubes 60*a*, 62*a*, 62*b*, 62*c*, 62*d*, 62*e*, 62*f*, 62*g* and 60*c* are integrally connected extensions or supports of which only 66*a* and 66*b* are shown. (Shown in FIGS. 4 and 5).

The rearwardly extending supports lie in a pair of horizontal planes which are parallel and separated by a predetermined distance between the planes.

Figure 5:
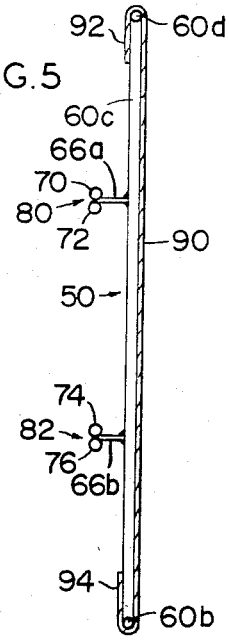
FIG. 5 is an elevational end view of a portion of the novel extensible brattice of the invention taken along lines 5—5 of FIG. 2.
Figure 4:
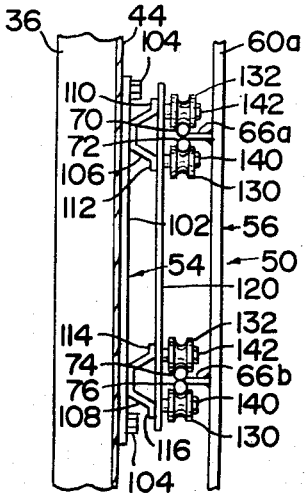
FIG. 4 is an end view of a portion of the extensible line brattice of the invention taken along lines 4—4 of FIG. 2.

As best shown in FIGS. 4 and 5, pairs of tubes 70, 72 and 74, 76 are integrally mounted together and to and along rearwardly extending supports 66*a*, 66*b* etc. It is thus seen that the extensible line brattice 32 has a pair of parallel rails 80 and 82 extending horizontally and parallel at a spaced distance between the matched rails. The rails 80 and 82 are made up of integrally connected tubes 70 and 72 and 74 and 76, respectively.

A brattice cloth 90 is mounted over the outer tubes 60*a*, 60*b*, 60*c* and 60*d* of moveable frame 50 to form a sheet completely covering the frame. Brattice cloth 90 may overlap the outer tubes, as shown at 92 and 94 to secure brattice cloth 90 in place. Brattice cloth 90 may be a scrim reinforced plastic material which is commercially availale for such purposes. Additionally, canvas or jute impregnated with a fireproofing agent may be used. The main characteristics of brattice cloth 90 are that it is air tight and fire resistant.

Figure 3:
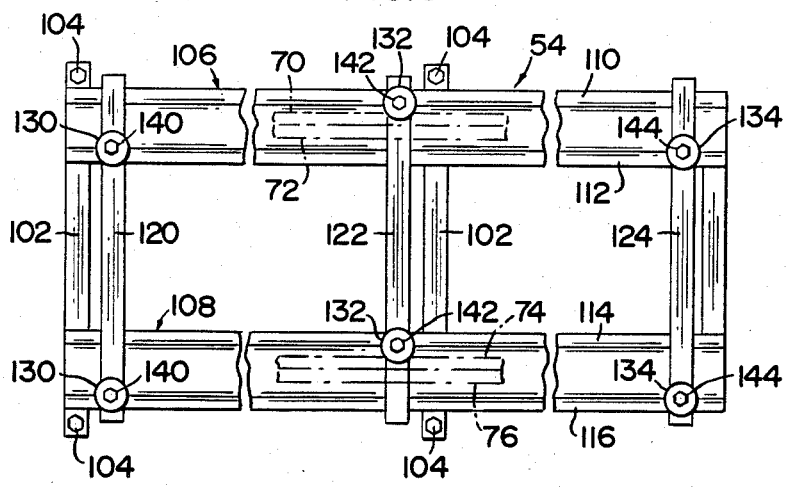
FIG. 3 is a detailed side view of a portion of the novel track system of the invention.

To form the track on which rails 80 and 82 are mounted for horizontal movement, a track system 54 is provided. Track system 54 is best seen in FIG. 3 which is a more detailed side view of track system 54 illustrated in FIG. 1. Track system 54 is mounted a distance substantially above the floor of the mine passageway, and preferably midway between the floor and ceiling of the mine passageway.

Track system 54 comprises a series of spaced brackets 102 which are secured to mine timbers 36 by lag bolts 104 or other means. Secured to spaced brackets 102 on the face thereof away from mine timbers 36 are a pair of parallel spaced U-shaped brackets 106 and 108. At its open end, U-shaped bracket 106 has an upwardly extending flange 110 and a downwardly extending flange 112. While U-shaped bracket 108 has an upwardly extending flange 114 and a downwardly extending flange 116 at its open end.

A series of spaced metal straps 120, 122, and 124 are secured to the flanges 110, 112, 114 and 116 of U-shaped brackets 106. Pairs of grooved guide wheels 130, 132, and 134 are mounted on straps 120, 122 and 124, respectively. Guide wheels 130 are mounted on strap 120 by bolts 140 to flanges 112 and 116, respectively. Guide wheels 132 are mounted on strap 122 by bolts 142 to flanges 110 and 114, respectively. Guide wheels 134 are mounted on strap 124 by bolts 144 to flanges 112 and 116, respectively.

It should be noted that the lower ones of guide wheels 130 and 134 are mounted on the lowermost flange 116 of U-shaped bracket 108. These guide wheels form the lower tracks for the lower rail 82 formed by pairs of tubes 74 and 76. Lower tube 76 of rail 82 rides in the grooves of wheels 130 and 134.

The upper ones of guide wheels 130 and 134 are mounted on the lowermost flange 112 of U-shaped bracket 106 to form the lower tracks for the upper rail 80 formed by pairs of tubes 70 and 72. Lower tube 72 of rail 80 rides in the grooves of wheels 130 and 134.

Spaced between pairs of guide wheels 130 and 134 are guide wheels 132 which act as the upper track for rails 80 and 82, respectively. Guide wheels 132 are mounted on strap 122 and to flanges 110 and 114 of U-shaped brackets 106 and 108, respectively. The grooves of guide wheels 132 partially encircle the upper edges of tubes 70 and 74 of rails 80 and 82, respectively, to keep moveable frame 56 in engagement with track system 54.

In summary, a fixed line brattice 30 is placed in a mine passageway under the area which is protected by roof bolts 24. Brattice 30 acts as an air foil to control the flow of air in the mine. To provide for an extensible line brattice, a track system 54 is mounted on mine timbers 36 at the free end of brattice 30. An extensible line brattice 32 is mounted by self-contained rails 80 and 82 to grooved track wheels 130, 132 and 134 on track system 54. Wheels 130 and 134 form the lower tracks for rails 80 and 82, respectively, while wheels 132 form the upper or locking tracks for rails 80 and 82, respectively. A brattice cloth is secured over line brattice 46 to act as an air foil in controlling the direction of flow of the air for ventilating the face 22 of mine passageway.

In operation after line brattice 30 is placed in position and prior to the installation of roof bolts in an unprotected area of the mine passageway, an extensible line brattice 32 is secured to the free end of line brattice 30. To secure the extensible line brattice 32 to line brattice 30, a track system is secured to mine timbers near the free end of the line brattice 30. An extensible line brattice frame 50 has previously been mounted on the tracks of said track section and is available for movement away from the free end of said fixed line brattice to become an extension of the fixed line brattice. The extensible line brattice is moved toward the working face of the mine passageway.

It is not necessary that there be a tight fit between the upper tube 60*d* and of extensible line brattice 32, and the roof of the mine passageway nor between the lower tube 60*b* of extensible line brattice 32 and the floor of the mine passageway. It is sufficient that the direction of the ventilating air be directed toward the working face of the mine passageway.

The extensible line brattice 32 may be replaced by a more permanent line brattice as mining progresses and as roof bolts are put in place. The extensible line brattice may be then reused by connecting it to the free end of the newly installed line brattice.

While a specific embodiment of the invention has been shown and described, other variations will occur to those skilled in the art and it is intended to cover this embodiment and other variations in the accompanying claims.

We claim:

1. In a mine, an extensible line brattice comprising a fixed line brattice having at least one free end; said fixed line brattice comprising spaced vertical support members and a brattice cloth attached to said spaced vertical support members to form an airtight curtain in said mine, a track system affixed to said free end of said fixed line brattice, said track system being affixed to at least two of said vertical support members and an extensible line brattice frame with an attached brattice cloth cover connected to said track system for horizontal movement of said extensible line brattice to elongate said fixed line brattice.

2. In a mine, the extensible line brattice of claim 1 wherein said vertical support members span the distance between the floor and ceiling of said mine and said track system is affixed to at least two of said vertical support members approximately midway between said roof and said ceiling of said mine.

3. In a mine, the extensible line brattice of claim 1 wherein said track system comprises pairs of spaced grooved wheels forming a track and said brattice frame has a pair of rails integrally mounted on one side of said frame, said rails being engaged by said pairs of spaced grooved wheels whereby said brattice frame may be extended horizontally away from said free end of said line brattice.

4. In a mine, the extensible line brattice of claim 3 wherein said track system comprises at least three pairs of grooved wheels, two of said pairs of grooved wheels being spaced fixed distances vertically and horizontally from each other to lie in a pair of parallel horizontal planes and said third pair of said grooved wheels being located intermediate said two of said pairs of grooved wheels and being vertically offset from said pair of parallel planes to form a track for engagement of said rails of said brattice frame to permit horizontal movement of said brattice frame.

5. In a mine, the extensible line brattice of claim 1 wherein, said extensible line brattice frame comprises a rectangular frame of tubular members, said tubular members having outwardly projecting extensions located in two parallel spaced planes, and pairs of tubular members attached to said extensions such that a pair of tubular members is connected to each of said extensions located in one of said parallel spaced planes, whereby a pair of rails is formed, said rails being adapted to be engaged by said track system for movement of said extensible line brattice to elongate said fixed line brattice.

* * * * *